US008881542B2

(12) United States Patent
Hixson et al.

(10) Patent No.: US 8,881,542 B2
(45) Date of Patent: Nov. 11, 2014

(54) REFRIGERATED MERCHANDISER

(75) Inventors: Scott N. Hixson, St. Louis, MO (US); Joshua T. Collier, House Springs, MO (US)

(73) Assignee: Hussmann Corporation, Bridgeton, MO (US)

( * ) Notice: Subject to any disclaimer, the term of this patent is extended or adjusted under 35 U.S.C. 154(b) by 2066 days.

(21) Appl. No.: 11/685,372

(22) Filed: Mar. 13, 2007

(65) Prior Publication Data

US 2008/0223061 A1 Sep. 18, 2008

(51) Int. Cl.
*F25D 21/04* (2006.01)
*A47F 3/04* (2006.01)
*F25D 23/02* (2006.01)

(52) U.S. Cl.
CPC ..... *A47F 3/0426* (2013.01); *F25D 21/04* (2013.01); *F25D 23/028* (2013.01)
USPC ..... 62/248

(58) Field of Classification Search
CPC ..... A47F 3/0426; F25D 23/028
USPC ..... 62/248; 219/645, 656, 740, 203, 522, 219/543
See application file for complete search history.

(56) References Cited

U.S. PATENT DOCUMENTS

| | | | | | |
|---|---|---|---|---|---|
| 3,313,920 | A | * | 4/1967 | Gallez | 219/522 |
| 3,475,588 | A | * | 10/1969 | McMaster | 219/203 |
| 3,524,920 | A | * | 8/1970 | Heaney et al. | 174/250 |
| 3,655,939 | A | * | 4/1972 | Stromquist | 219/218 |
| 3,892,947 | A | * | 7/1975 | Strengholt | 219/522 |
| 3,911,245 | A | * | 10/1975 | O'Shaughnessy | 219/218 |
| 4,248,015 | A | * | 2/1981 | Stromquist et al. | 49/70 |
| 4,762,595 | A | * | 8/1988 | Postupack et al. | 430/325 |
| 5,852,284 | A | * | 12/1998 | Teder et al. | 219/522 |
| 6,051,820 | A | * | 4/2000 | Poix et al. | 219/522 |
| 6,144,017 | A | * | 11/2000 | Millett et al. | 219/522 |
| 6,148,563 | A | * | 11/2000 | Roche et al. | 49/501 |
| 6,461,736 | B1 | * | 10/2002 | Nagashima et al. | 428/432 |
| 2005/0178756 | A1 | * | 8/2005 | Degand et al. | 219/203 |

OTHER PUBLICATIONS

Hussmann Corporation, Hussmann Innovator Glass Doors, 2006, Bridgeton, MO.

* cited by examiner

*Primary Examiner* — Frantz Jules
*Assistant Examiner* — Emmanuel Duke
(74) *Attorney, Agent, or Firm* — Michael Best & Friedrich LLP

(57) ABSTRACT

A door for a refrigerated merchandiser that includes a glass panel having a first portion and a second portion spaced from the first portion. The door also includes a first conductive film covering the first portion of the glass panel and a second conductive film spaced apart from the first conductive film and covering the second portion of the glass panel.

27 Claims, 3 Drawing Sheets

REFRIGERATED MERCHANDISER

BACKGROUND

The present invention relates to refrigerated merchandisers and, more particularly, to glass doors for refrigerated merchandisers.

Refrigerated merchandisers generally include a case defining a product display area for supporting and displaying food products to be visible and accessible through an opening in the front of the case. Refrigerated merchandisers are generally used in retail food store applications such as grocery or convenient stores or other locations where food product is displayed in a refrigerated condition. Some refrigerated merchandisers include doors to enclose the product display area of the case and reduce the amount of cold air released into the surrounding environment. The doors typically include a glass panel, allowing a consumer to view the food products stored inside the case.

Refrigerated merchandisers may be susceptible to condensation forming on the glass panel of the door, which obstructs viewing of the food product positioned inside the case. In particular, condensation is most likely to form at the lowest portion of the glass panel, where the door is the coldest.

SUMMARY

In one embodiment, the invention provides a refrigerated merchandiser for displaying food product. The refrigerated merchandiser includes a case, a refrigeration system in communication with the case, and at least one door coupled to the case. Each door includes a glass panel having a first portion and a second portion spaced from the first portion. Each door also includes a first conductive film covering the first portion of the glass panel and a second conductive film spaced apart from the first conductive film and covering the second portion of the glass panel. The refrigerated merchandiser also includes a power supply in electrical communication with the first conductive film and the second conductive film to heat the first portion and the second portion.

In another embodiment, the invention provides a door for a refrigerated merchandiser. The door includes a glass panel having a first portion and a second portion spaced from the first portion. The door also includes a first conductive film covering the first portion of the glass panel and a second conductive film spaced apart from the first conductive film and covering the second portion of the glass panel.

In yet another embodiment, the invention provides a method of heating a door. The method includes providing a glass panel, covering a first portion of the glass panel with a first conductive film, and covering a second portion of the glass panel with a second conductive film spaced apart from the first conductive film. The method also includes applying electricity from a power supply through the first conductive film and the second conductive film to heat the first portion and the second portion.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein are for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
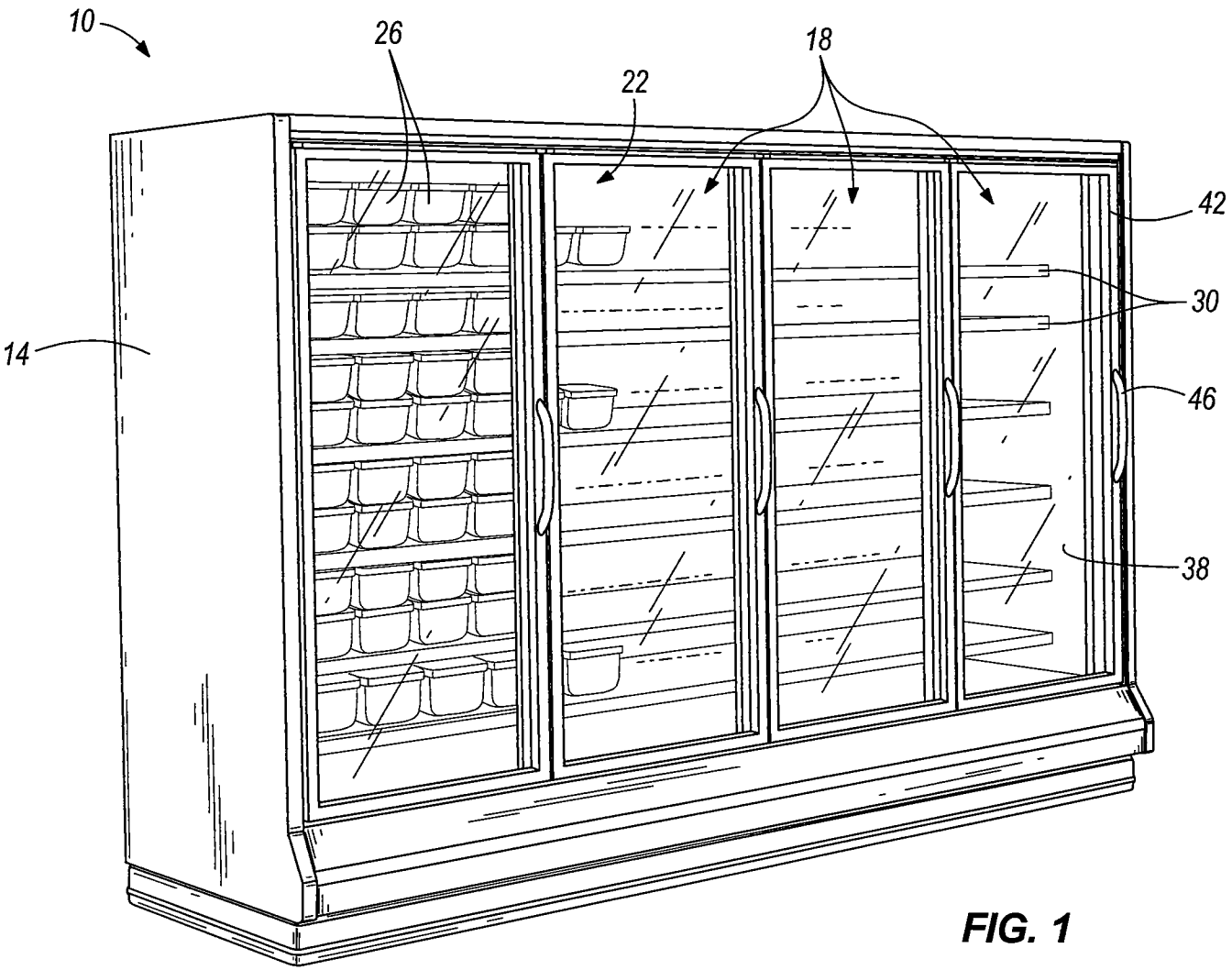
FIG. 1 is a perspective view of a refrigerated merchandiser according to one embodiment of the invention.

FIG. 1 illustrates a refrigerated merchandiser 10 according to one embodiment of the present invention. The refrigerated merchandiser 10 includes a case 14 and a plurality of doors 18. In the illustrated embodiment, the refrigerated merchandiser 10 includes four doors 18. However, it should be readily apparent to one skilled in the art that the refrigerated merchandiser 10 may include fewer or more doors 18 depending on the size of the case 14.

The case 14 defines a product display area 22 for supporting and displaying food product 26 within the case 14. For example, the food product 26 can be displayed on shelves or racks 30 extending forwardly from a rear wall of the case 14. In the illustrated embodiment, the product display area 22 is accessible through the front of the case 14. In other embodiments, the product display area 22 is accessible through a top of the case 14.

The refrigerated merchandiser 10 also includes a refrigeration system (not shown) that provides refrigerated airflow to the product display area 22. Although not shown, the refrigeration system generally includes an evaporator located within an air passageway internal to the case. Remotely located compressors compress a gaseous refrigerant and direct the compressed refrigerant to an exterior condenser where the refrigerant is cooled and condenses into a liquid refrigerant that is directed to the evaporator. Prior to reaching the evaporator, the liquid refrigerant is forced through an expansion valve converting the refrigerant into a two-phase fluid. The two-phase refrigerant absorbs heat from air being directed through the evaporator by a fan. The refrigerant generally leaves the evaporator in a superheated condition and is routed back to the compressor for recycling. The cooled air exiting the evaporator is directed through the remainder of the air passageway and is introduced into the product display area 22, where it will remove heat from the displayed food products 26 and maintain the food products 26 at the desired temperature.

Figure 2:
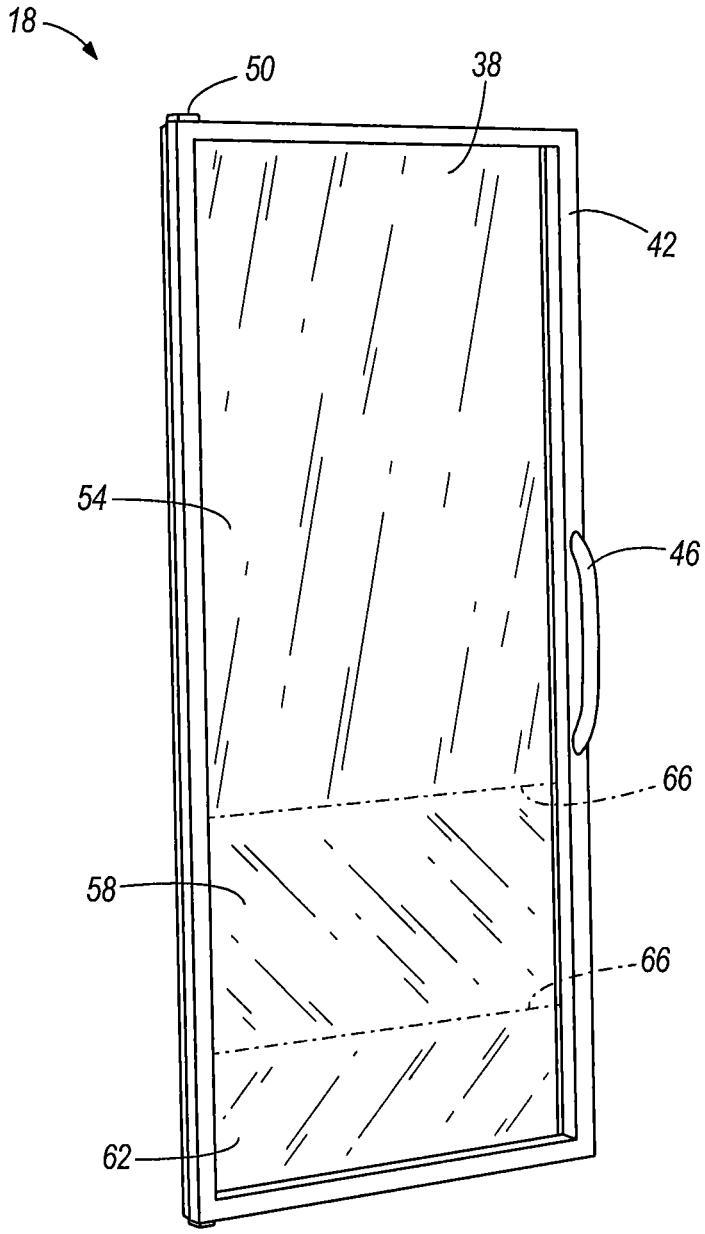
FIG. 2 is a front view of a door of the refrigerated merchandiser of FIG. 1.

FIG. 2 illustrates one door 18 of the refrigerated merchandiser 10. The door 18 includes a glass panel 38, a frame 42, and a handle 46 to facilitate opening of the door 18. The frame 42 surrounds the perimeter of the glass panel 38 and is constructed from a non-conductive material such as, for example, fiberglass. A hinge 50 is positioned on one side of the frame 42 to couple the door 18 to the case 14, such that the door 18 may be pivoted about the hinge 50 to allow access to the food product 26 stored within the case 14. In some embodiments, the frame 42 includes a rubber gasket and magnets on an interior surface (i.e., the side facing the food product) to ensure proper sealing between the door 18 and the case 14. In other embodiments, the door 18 may be slidably received by a track in the case 14, such that sliding the door 18 within the track allows access to the food product 26.

As shown in FIG. 2, a transparent resistive coating is applied to a surface of the glass panel 38. In the illustrated embodiment, the resistive coating is applied to three separate glass panel portions defining corresponding conductive film sections 54, 58, 62. However, in other embodiments, the resistive coating may be divided into fewer or more sections than the amount illustrated. Additionally or alternatively, the relative sizes of each of the sections may vary. For example, the sizes of the sections can increase from top to bottom, can decrease from top to bottom, or can vary from section to section without following a conventional pattern.

In the embodiment illustrated in FIG. 2, the first section 54, or first conductive film, covers an upper portion of the glass panel 38, the second section 58, or second conductive film, covers a middle portion of the glass panel 38, and the third section 62, or third conductive film, covers a lower portion of the glass panel 38. The films 54, 58, 62 are applied to the glass panel 38 such that a small gap 66 exists between each of the adjacent films 54, 58, 62, at least partially electrically isolating the films 54, 58, 62. That is, the films 54, 58, 62 are not in direct physical or electrical contact with each other. The gap 66 may be formed by spacing the films 54, 58, 62 apart during the application process, or by etching the glass panel 38 after the films 54, 58, 62 have been applied.

The conductive films 54, 58, 62 are configured to heat the door 18, inhibiting the formation of condensation on the outside of the glass panel 38. The films 54, 58, 62 provide a variable amount of heat along the glass panel 38, allowing for efficient use of the supplied energy. A power supply couples to the door 18 to apply electricity through the conductive films 54, 58, 62. The films 54, 58, 62 have a sufficient resistance to heat the glass panel 38, thereby stopping condensation from forming. In addition, the films 54, 58, 62 are sized and positioned such that the greatest amount of heat is generated at the lowest film (e.g., the third film 62) to counteract the portion of the glass panel 38 with the highest likelihood for condensation formation.

The conductive films 54, 58, 62 are applied to the glass panel 38, for example, as a metallic pyrolytic coating or as a magnetic sputter vacuum deposition coating. Metallic pyrolytic coatings, or hard coats, deposit a metallic oxide directly onto the glass panel 38 while the glass panel 38 is still hot and are very hard and durable. Magnetic sputter vacuum deposition coatings, or soft coats, use a vacuum chamber to apply several layers of a coating onto the glass panel 38. A protective layer can be applied over the conductive coating to protect the coating from contact with foreign objects.

Figure 3A:
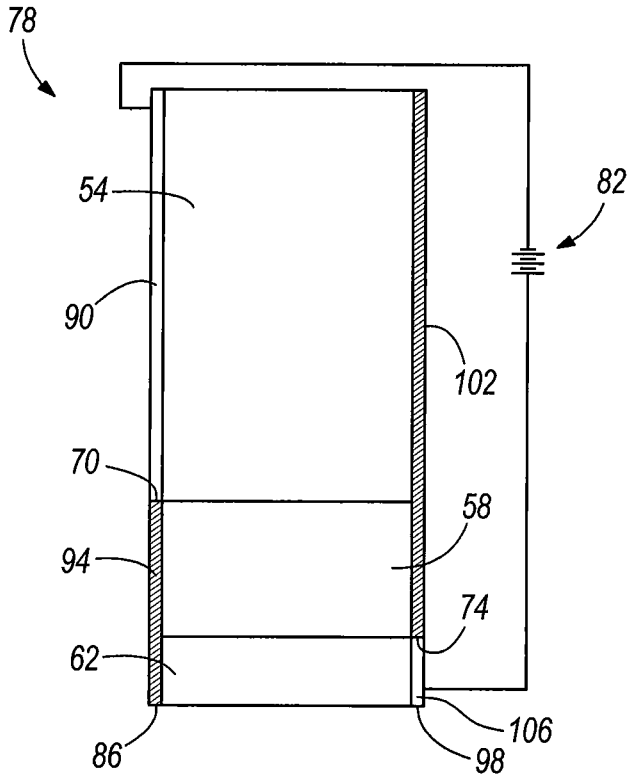
FIG. 3A is a schematic diagram of one embodiment of the door of FIG. 2 arranged as a series circuit.
Figure 4B:
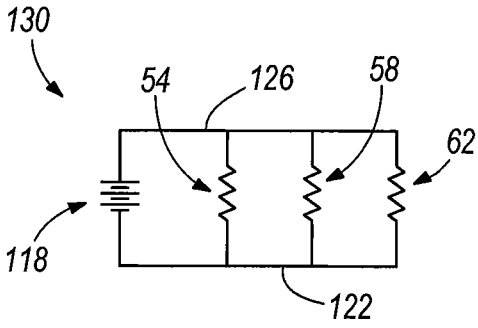
FIG. 4B is a parallel circuit diagram.
Figure 4A:
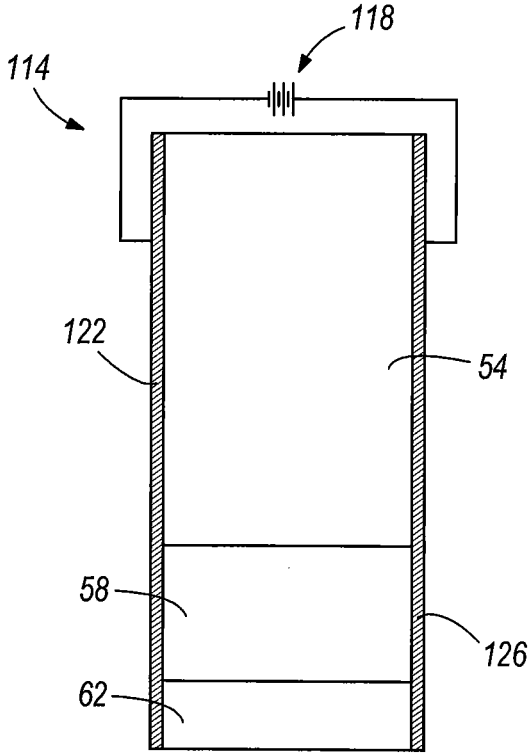
FIG. 4A is a schematic diagram of one embodiment of the door of FIG. 2 arranged as a parallel circuit.

The conductive films 54, 58, 62 electrically couple to the power supply in series or in parallel via conductive foil strips (see FIGS. 3A and 4A). The foil strips may be made of copper or any other suitable conductive material. Typically, the foil strips are positioned between the glass panel 38 and the frame 42. In some embodiments, such as the embodiment discussed below with reference to FIG. 3A, the foil strips may include discontinuities 70, 74, which can be formed by laser cutting, abrasive grinding, and/or polishing.

FIG. 3A schematically illustrates a door 78 according to one embodiment of the door 18 shown in FIG. 2. In the illustrated embodiment, the door 78 includes the conductive films 54, 58, 62 electrically coupled to a power supply 82 in series. The discontinuity 70 is formed in a first foil strip 86 between the first film 54 and the second film 58, such that a first portion 90 of the first foil strip 86 extends along one side of the first film 54, and a second portion 94 of the first foil strip 86 extends along the same side of the second and third films 58, 62. The discontinuity 74 is formed in a second foil strip 98 between the second film 58 and the third film 62, such that a first portion 102 of the second foil strip 98 extends along another side of the first and second films 54, 58, and a second portion 106 of the second foil strip 98 extends along the same side of the third film 62. The power supply 82 couples between the first portion 90 of the first foil strip 86 and the second portion 106 of the second foil strip 92 to provide electricity through the conductive films 54, 58, 62.

Figure 3B:
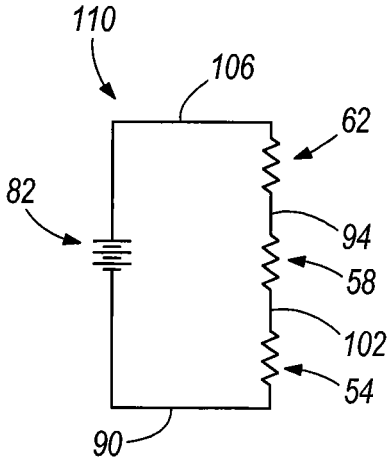
FIG. 3B is a series circuit diagram.

FIG. 3B illustrates a series circuit 110 corresponding to the door 78 of FIG. 3A. Resistors and electrical lines of the circuit 110 have been given reference numerals corresponding the conductive films 54, 58, 62, first and second portions 90, 94 of the first foil strip 86, and first and second portions 102, 106 of the second foil strip 98 of FIG. 3A.

FIG. 4A schematically illustrates a door 114 according to another embodiment of the door 18 shown in FIG. 2. In the illustrated embodiment, the door 114 includes the conductive films 54, 58, 62 electrically coupled to a power supply 118 in parallel. A first foil strip 122 continuously extends along one side of the first, second, and third films 54, 58, 62. A second foil strip 126 continuously extends along another side of the first, second, and third films 54, 58, 62. The power supply 118 couples between the first foil strip 122 and the second foil strip 126 to provide electricity through the conductive films 54, 58, 62.

FIG. 4B illustrates a parallel circuit 130 corresponding to the door 114 of FIG. 4A. Resistors and electrical lines of the circuit 130 have been given reference numerals corresponding with the conductive films 54, 58, 62 and the foil strips 122, 126 of FIG. 4A.

Described below is one embodiment of a door having conductive films electrically coupled in series. The films are configured so the first film (e.g., top film) uses approximately 10% of the total power supplied to the door, the second film (e.g., middle film) uses approximately 30% of the total power, and the third film (e.g., bottom film) uses approximately 60% of the total power. In other words, the first film covers approximately 67% of the glass panel, the second film covers approximately 22% of the glass panel, and the third film covers approximately 11% of the glass panel. The power used by each film can be calculated as shown below when 112.7 volts are applied to a glass panel having dimensions of approximately 26.875 inches by 62.73 inches.

First, the resistance of each conductive film is calculated using the following equation:

$$R = R_A \frac{L}{W}$$

$$R_3 = 60.8\Omega * \frac{26.875''}{6.97''} = 243.4\Omega$$

$$R_2 = 60.8\Omega * \frac{26.875''}{13.94''} = 116.1\Omega$$

$$R_1 = 60.8\Omega * \frac{26.875''}{41.82''} = 39.8\Omega$$

where $R_A$ is the Ohms per square (standard unit for sheet resistances), L is the length of the films (e.g., the distance between foil strips), W is the width of the films (e.g., the length film in contact with a foil strip), $R_3$ is the resistance of the third film, $R_2$ is the resistance of the second film, and $R_1$ is the resistance of the first film Next, the amount of current flowing through the conductive films is calculated using the following equation:

$$I = \frac{V}{R_3 + R_2 + R_1} = \frac{112.7V}{243.4\Omega + 116.1\Omega + 39.8\Omega} = 0.283A$$

where V is the supplied voltage.

Once the current is known, the total power required by the door is calculated using the following equation:

$$P = I^2*(R_3+R_2+R_1) = (0.283\text{ A})^2*(243.4\Omega+116.1\Omega+39.8\Omega) = 31.9\text{ W}$$

Power used for each conductive film is calculated in a similar manner:

$$P_{section} = I^2*R_{section}$$

$$P_3 = (0.283\text{ A})^2*243.2\Omega = 19.4\text{ W}$$

$$P_2 = (0.283\text{ A})^2*116.1\Omega = 9.3\text{ W}$$

$$P_1 = (0.283\text{ A})^2*39.8\Omega = 3.2\text{ W}$$

where $P_3$ is the power used by the third film, $P_2$ is the power used by the second film, and $P_1$ is the power used by the first film.

In addition, the Watts per square foot required for each conductive film can be calculated as follows:

$$q_3'' = \frac{\text{power}}{\text{area}} = \frac{19.4W}{26.875''*6.97''}*\frac{12''}{1\text{ ft}}*\frac{12''}{1\text{ ft}} = 14.61\frac{W}{\text{ft}^2}$$

$$q_2'' = \frac{\text{power}}{\text{area}} = \frac{9.3W}{26.875''*13.94''}*\frac{12''}{1\text{ ft}}*\frac{12''}{1\text{ ft}} = 3.57\frac{W}{\text{ft}^2}$$

$$q_1'' = \frac{\text{power}}{\text{area}} = \frac{3.2W}{26.875''*41.82''}*\frac{12''}{1\text{ ft}}*\frac{12''}{1\text{ ft}} = 0.41\frac{W}{\text{ft}^2}$$

where $q''_3$ is the Watts per square foot of the third film, $q''_2$ is the Watts per square foot of the second film, and $q''_1$ is the Watts per square foot of the first film.

The table below summarizes the total power utilized by doors having different size ratios of conductive films:

| Section 1 % of Total | Section 2 % of Total | Section 3 % of Total | Section 1 (Watts/ft^2) | Section 2 (Watts/ft^2) | Section 3 (Watts/ft^2) | Total Power (Watts) |
|---|---|---|---|---|---|---|
| 33% | 33% | 33% | 4.69 | 4.69 | 4.69 | 54.92 |
| 50% | 25% | 25% | 1.69 | 6.76 | 6.76 | 49.43 |
| 75% | 13% | 13% | 0.25 | 8.99 | 8.99 | 28.52 |
| 38% | 38% | 25% | 3.45 | 3.45 | 7.75 | 52.96 |
| 45% | 30% | 25% | 2.28 | 5.14 | 7.40 | 51.73 |
| 80% | 10% | 10% | 0.15 | 9.35 | 9.35 | 23.26 |
| 60% | 30% | 10% | 0.52 | 2.08 | 18.76 | 32.95 |
| 70% | 20% | 10% | 0.32 | 3.91 | 15.64 | 30.09 |
| 100% | 0% | 0% | 7.75 | 0.00 | 0.00 | 90.72 |

As can be seen from the table, dividing the resistive coating into sections decreases the total power required to heat the glass panel of the door. For example, when a single film covers the entire glass panel, 7.75 Watts/ft^2 are required to heat each part of the glass panel and 90.72 Watts of total power are used. When the resistive coating is divided into three sections (e.g., the 38/38/25 ratio), 7.75 Watts/ft^2 are required to heat only the lowest section and 3.45 Watts/ft^2 are required to heat the other two sections. Therefore, the total power required to heat the glass panel drops to 52.96 Watts. Other ratios not specifically shown in the table may allow for even lower total power usage.

In some embodiments, conductive films having different resistivities (e.g., $R_A$ values) may be applied to a glass panel. For example, the conductive films may include different materials or metals, or the conductive films may be applied with different thicknesses on the glass panel.

In other embodiments, conductive films may be arranged on a glass panel horizontally. For example, the conductive films may be arranged with a first film covering the leftmost portion of the glass panel, a second film covering the middle portion of the glass panel, and a third film covering the rightmost portion of the glass panel. Arranging the films in this manner can facilitate condensation inhibition at edges of a door, for example, near a hinge.

In further embodiments, multiple doors may electrically couple to a common power supply, forming one circuit. The circuit may include doors having conductive films arranged in series and doors having conductive films arranged in parallel. Additionally or alternatively, each door may include a combination of conductive films arranged in both series and parallel.

In still other embodiments, a refrigerated merchandiser may include a glass panel as part of the case instead of or in addition to the door. The glass panel on the case may also include conductive films to inhibit condensation formation thereon.

Various features and advantages of the invention are set forth in the following claims.

What is claimed is:

1. A refrigerated merchandiser for displaying food product, the refrigerated merchandiser comprising:

a case;

a refrigeration system in communication with the case;

at least one door coupled to the case, each door including a glass panel having a first portion and a second portion spaced from and lower than the first portion, a first conductive film covering the first portion of the glass panel, the first conductive film partially defined by a thickness and a substantially constant width, and a second conductive film spaced apart from the first conductive film and covering the second portion of the glass panel, the second conductive film partially defined by a thickness and a substantially constant width, the first conductive film and the second conductive film having substantially the same thickness and different widths; and a power supply in electrical communication with the first conductive film and the second conductive film to heat the first portion and the second portion, the second conductive film generating more heat than the first conductive film such that the heat applied to the first and second portions increases in a downward direction along the glass panel to inhibit formation of condensation on the glass panel.

2. The refrigerated merchandiser of claim 1 wherein the glass panel includes a third portion spaced from and lower than the first portion and the second portion, and wherein the door further comprises a third conductive film spaced apart from the first conductive film and the second conductive film, the third conductive film covering the third portion, the third conductive film generating more heat than the second conductive film.

3. The refrigerated merchandiser of claim 2 wherein the third conductive film is partially defined by a thickness and a substantially constant width, and wherein the width of the third conductive film is different from at least one of the width of the first conductive film and the width of the second conductive film.

4. The refrigerated merchandiser of claim 2 wherein the first film, the second film, and the third film are positioned relative to each other such that heat increases downward along an entire length of the glass panel.

5. The refrigerated merchandiser of claim 1 wherein the first conductive film and the second conductive film are connected to the power supply in series.

6. The refrigerated merchandiser of claim 1 wherein the first conductive film and the second conductive film are connected to the power supply in parallel.

7. The refrigerated merchandiser of claim 1 wherein the first conductive film and the second conductive film are at least one of a metallic pyrolytic coating and a magnetic sputter vacuum deposition coating.

8. The refrigerated merchandiser of claim 1 wherein the first conductive film and the second conductive film are transparent.

9. The refrigerated merchandiser of claim 1 wherein the first conductive film and the second conductive film are at least partially electrically isolated from each other.

10. A door for a refrigerated merchandiser, the door comprising:

a glass panel having a first portion and a second portion spaced from and lower than the first portion;

a first conductive film covering the first portion of the glass panel and partially defined by a thickness and a substantially constant width; and a second conductive film spaced apart from the first conductive film and covering the second portion of the glass panel, the second conductive film partially defined by a thickness and a substantially constant width, the first conductive film and the second conductive film having substantially the same thickness and different widths, the first conductive film and the second conductive film configured to be connected to a power supply to heat the first and second portions, the second conductive film generating more heat than the first conductive film such that the heat applied to the glass panel increases in a downward direction to inhibit formation of condensation on the first and second portions.

11. The door of claim 10 wherein the glass panel includes a third portion spaced from and lower than the first portion and the second portion, and wherein the door further comprises a third conductive film spaced apart from the first conductive film and the second conductive film, the third conductive film covering the third portion, the third conductive film generating more heat than the second conductive film.

12. The door of claim 11 wherein the third conductive film is partially defined by a thickness and a substantially constant width, and wherein the width of the third conductive film is different from at least one of the width of the first conductive film and the width of the second conductive film.

13. The door of claim 11 wherein the first film, the second film, and the third film are positioned relative to each other such that heat increases downward along an entire length of the glass panel.

14. The door of claim 10 wherein the first conductive film and the second conductive film are electrically coupled in series.

15. The door of claim 10 wherein the first conductive film and the second conductive film are electrically coupled in parallel.

16. The door of claim 10 wherein the first conductive film and the second conductive film are at least one of a metallic pyrolytic coating and a magnetic sputter vacuum deposition coating.

17. The door of claim 10 wherein the first conductive film and the second conductive film are transparent.

18. The door of claim 10 wherein the first conductive film and the second conductive film are at least partially electrically isolated from each other.

19. A method of heating a door, the method comprising:

providing a glass panel;

covering a first portion of the glass panel with a first conductive film partially defined by a thickness and a substantially constant width;

covering a second portion of the glass panel with a second conductive film spaced apart from the first conductive film, the second portion lower than the first portion, and the second conductive film partially defined by a thickness and a substantially constant width, the first conductive film and the second conductive film having substantially the same thickness and different widths;

applying electricity from a power supply through the first conductive film to heat the first portion;

applying electricity from the power supply through the second conductive film to heat the second portion; and increasing the heat on the glass panel in a downward direction along the glass panel.

20. The method of claim 19 and further comprising inhibiting condensation from forming on the first portion and the second portion.

21. The method of claim 19 and further comprising applying the first conductive film and the second conductive film by sputtering.

22. The method of claim 19 and further comprising applying the first conductive film and the second conductive film by pyrolytic coating.

23. The method of claim 19 and further comprising electrically coupling the first conductive film and the second conductive film to the power supply in parallel.

24. The method of claim 19 and further comprising electrically coupling the first conductive film and the second conductive film to the power supply in series.

25. The method of claim 19 and further comprising at least partially electrically isolating the first conductive film from the second conductive film.

26. The method of claim 19 and further comprising covering a third portion of the glass panel with a third conductive film partially defined by a thickness and a substantially constant width, wherein the width of the third conductive film is different from at least one of the width of the first conductive film and the width of the second conductive film.

27. The method of claim 26, further comprising increasing the heat in the downward direction along the entire length of the glass panel.

* * * * *